US006497232B2

(12) United States Patent
Fecteau et al.

(10) Patent No.: US 6,497,232 B2
(45) **Date of Patent: *Dec. 24, 2002**

(54) RESPIRATOR HEADPIECE AND RELEASE MECHANISM

(75) Inventors: Keith E. Fecteau, Wilbraham, MA (US); David Honan, Concord, MA (US); Kevin M. Krauss, Brighton, MA (US); Alan Levin, New Haven, CT (US)

(73) Assignee: Cabot Safety Intermediate Corporation, Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/981,576

(22) Filed: Oct. 16, 2001

(65) Prior Publication Data

US 2002/0078953 A1 Jun. 27, 2002

Related U.S. Application Data

(63) Continuation of application No. 09/608,899, filed on Jun. 30, 2000, which is a continuation-in-part of application No. 09/255,601, filed on Feb. 22, 1999, now Pat. No. 6,338,342.

(51) Int. Cl.[7] ..... A62B 18/08

(52) U.S. Cl. ..... 128/207.11; 128/201.24; 128/206.24; 128/206.12; 128/207.11

(58) Field of Search ..... 128/205.25, 206.12, 128/206.21, 206.24, 207.11, 201.24; 2/421, 417

(56) References Cited

U.S. PATENT DOCUMENTS

| | | | |
|---|---|---|---|
| 509,718 | A | 11/1893 | Behrens |
| 671,616 | A | 4/1901 | Thompson |
| 1,055,067 | A | 3/1913 | Molloy |
| 1,398,966 | A | 12/1921 | Hirsh |
| 1,798,576 | A | 3/1931 | Alonso |
| 2,008,677 | A | 7/1935 | Booharin |
| 2,056,692 | A | 10/1936 | Roche |
| 2,079,581 | A | 5/1937 | Whipple |
| 2,149,067 | A | 2/1939 | Otero |
| 2,176,709 | A | 10/1939 | Dym |
| 2,228,379 | A | 1/1941 | Woodard |
| 2,281,744 | A | 5/1942 | Brunner |
| 2,353,643 | A | 7/1944 | Bulbulian |
| 2,505,173 | A | 4/1950 | Conley |
| 2,762,368 | A | 9/1956 | Bloomfield |
| 2,780,224 | A | 2/1957 | Wallace |
| 2,814,293 | A | 11/1957 | Gabb |
| 2,843,121 | A | 7/1958 | Hudson |
| 2,867,812 | A | 1/1959 | Roth et al. |
| 2,875,757 | A | 3/1959 | Galleher |
| 2,921,581 | A | 1/1960 | Swearingen |
| 2,928,387 | A | 3/1960 | Layne |
| 2,970,593 | A | 2/1961 | Seeler |

(List continued on next page.)

FOREIGN PATENT DOCUMENTS

| | | |
|---|---|---|
| CA | 643803 | 6/1962 |
| GB | 2 059 782 | 4/1981 |
| GB | 2 092 009 A | 8/1982 |
| WO | WO 93/14819 | 8/1993 |

*Primary Examiner*—Dennis Ruhl
*Assistant Examiner*—Michael G. Mendoza
(74) *Attorney, Agent, or Firm*—Cantor Colburn LLP

(57) ABSTRACT

A quick release mechanism and headpiece for use with a respirator. The quick release mechanism uses a cam latch pivotally attached to a yoke to control the tension in an upper tension strap. In the latched position the upper tension strap traverses the yoke to support and seal the respirator mask against the face of the wearer. In the unlatched position the upper tension straps loosely support the mask below the chin of the wearer in a parked position. In one embodiment, a guide is provided on the yoke to ensure that the mask may be consistently donned and doffed with minimal effort (e.g., potential one-handed donning and doffing). An opening may also be provided in the face mask and optionally in the yoke, and a filter may be disposed within the opening to provide the desired filtration of inhaled gases.

21 Claims, 12 Drawing Sheets

U.S. PATENT DOCUMENTS 3,013,556 A 12/1961 Galleher
3,033,200 A 5/1962 Stanley
3,040,741 A 6/1962 Carolan
3,056,402 A 10/1962 Dickinson
3,079,917 A 3/1963 Pate
3,082,767 A 3/1963 Matheson
3,092,105 A 6/1963 Gabb
3,117,574 A 1/1964 Replogle
3,234,939 A 2/1966 Morton, Jr.
3,234,940 A 2/1966 Morton, Jr.
3,299,889 A 1/1967 Stanley
3,347,229 A 10/1967 Heitman
3,379,195 A 4/1968 Bleach
3,457,564 A 7/1969 Holloway
3,563,600 A 2/1971 Converse
3,574,862 A 4/1971 Jones et al.
3,599,635 A 8/1971 Ansite
3,752,157 A 8/1973 Malmin
3,815,326 A 6/1974 Christensen
3,850,168 A 11/1974 Ferguson et al.
3,971,373 A 7/1976 Braun
4,002,167 A 1/1977 Rambosek
4,057,057 A 11/1977 Backlund
4,074,397 A 2/1978 Rosin
4,077,068 A 3/1978 Anderson
4,112,521 A 9/1978 Uke
4,414,973 A 11/1983 Matheson et al.
4,520,509 A 6/1985 Ward
4,536,440 A 8/1985 Berg
4,559,939 A 12/1985 Levine et al.
4,603,692 A * 8/1986 Montesi ..... 128/207.11
4,676,236 A 6/1987 Piorkowski et al.
4,790,306 A 12/1988 Braun et al.
4,807,619 A 2/1989 Dyrud et al.
4,811,728 A 3/1989 Von Kopp
4,827,924 A 5/1989 Japuntich
4,848,334 A 7/1989 Bellm
4,850,346 A 7/1989 Michel et al.
4,934,361 A 6/1990 Michel et al.
4,955,087 A 9/1990 Perez et al.
4,960,121 A 10/1990 Nelson et al.
5,033,465 A 7/1991 Braun et al.
5,052,084 A 10/1991 Braun
5,062,421 A 11/1991 Burns et al.
5,181,507 A 1/1993 Michel et al.
5,237,896 A 8/1993 Seppala et al.
5,291,880 A 3/1994 Almovist et al.
5,406,340 A 4/1995 Hoff
5,433,612 A 7/1995 Daku
5,441,046 A 8/1995 Starr et al.
5,464,010 A 11/1995 Byram
5,507,284 A 4/1996 Daneshvar
5,517,986 A 5/1996 Starr et al.
5,555,571 A 9/1996 McCaffrey
5,592,937 A 1/1997 Freund
5,596,652 A 1/1997 Piatek et al.
5,608,917 A 3/1997 Landis et al.
5,724,677 A 3/1998 Bryant
5,793,882 A 8/1998 Piatek et al.
5,990,793 A 11/1999 Bieback
6,029,889 A 2/2000 Whalen, Jr. et al.
6,338,342 B1 1/2002 Fecteau et al.

* cited by examiner

RESPIRATOR HEADPIECE AND RELEASE MECHANISM

CROSS REFERENCE TO RELATED APPLICATIONS

The present application is a continuing application of co-pending application Ser. No. 09/608,899, filed Jun. 30, 2000, which is a continuation-in-part application of copending application Ser. No. 09/255,601, filed Feb. 22, 1999, now U.S. Pat. No. 6,338,342 both of which are specifically incorporated by reference herein.

BACKGROUND

Respirators are worn by persons subjected to unpleasant or noxious environments. A common type of respirator is the half mask respirator, which comprises a cup type mask supported by a yoke attached to two sets of straps. One set of straps, the upper set, is designed to rest on the crown of the head of a wearer. The second, lower, set is designed to wrap around the back of the neck of the wearer. The upper set is generally attached to a broadened flexible strap, commonly known as a cradle, that fits over, or cradles, the crown of the head. The upper strap is generally adjustably attached between the facepiece and cradle by a buckle having an adjusting mechanism such as a D-ring for tightening the strap against the head. A D-ring, as is well known in the industry, generally requires that a wearer use two hands to manipulate the D-ring to adjust the length of the strap during donning or doffing often proving to be challenging to the wearer. The lower strap generally includes a fastening element including a hook and slot arrangement and further includes an adjustment mechanism such as a D-ring.

A wearer typically puts on (dons) the respirator by clipping the lower straps behind the neck and then lifting the cradle up onto the top of the crown while simultaneously guiding the mask and yoke portion, or facepiece, into position on the face. The straps are then manipulated through the D-rings and adjusted until a good fit is achieved and a successful face seal check is performed. Removal, or doffing, of the respirator is performed opposite the donning operation wherein the lower straps are unbuckled and the cradle is removed from the head while the facepiece is withdrawn from the face of the wearer.

In the course of an average day, a worker required to wear a respirator may don and doff the respirator up to 20 times. The donning procedures of current art respirators, including adjustment and face seal check, are viewed by many wearers as being complex and cumbersome. In some cases wearers forego the donning procedure when it is perceived that the task they are to perform would take less time than the donning procedure. The donning procedure is further complicated by other protective equipment such as goggles, glasses, earmuffs, hats and hard hats that need to be removed in order to don or doff the respirator.

The doffing of current respirators is viewed by many wearers as an equally cumbersome task. In order to remove the respirator, even for short periods, the lower strap must be unbuckled and the cradle lifted off the head as described herein above. A temporary removal, or parking, of the respirator is performed by slipping the cradle off the back of the head and allowing the facepiece to drop in front of the wearer wherein the respirator is supported by the lower strap around the neck of the wearer. Both the complete doffing and the parking of the respirator are further hampered by the inclusion of safety equipment as set forth herein above.

Another problem with prior art respirators results when respirators rely on upper straps having no elongation. Over time, latching of rigid straps causes material fatigue in the mask and may cause breakage of the mask during donning.

Another problem with prior art respirators is that the strap attachments, as well as tightening and release mechanisms, cause point loads in the facepiece making them uncomfortable to the wearer.

Accordingly, there remains a need in the art for a respirator that may be easily and conveniently donned, doffed and parked without discomfort to the wearer.

SUMMARY

The above discussed and other drawbacks and deficiencies of the prior art are overcome or alleviated by the present respirator headpiece and quick release respirator mechanism. In one embodiment, the quick release respirator mechanism includes a yoke attached to the respirator face mask. An over center cam latch is pivotally attached to the yoke. At least one strap is attached to the latch, such that actuation of the latch to a latched position increases tension in the strap, which supports and seals the respirator mask against the face of the wearer. In one embodiment, a guide is provided on the yoke to ensure that the mask may be consistently donned and doffed with minimal effort (e.g., potential one-handed donning and doffing). An opening may also be provided in the face mask and optionally in the yoke, and a filter may be disposed within the opening to provide the desired filtration of inhaled gases.

The above discussed and other features and advantages will be appreciated and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
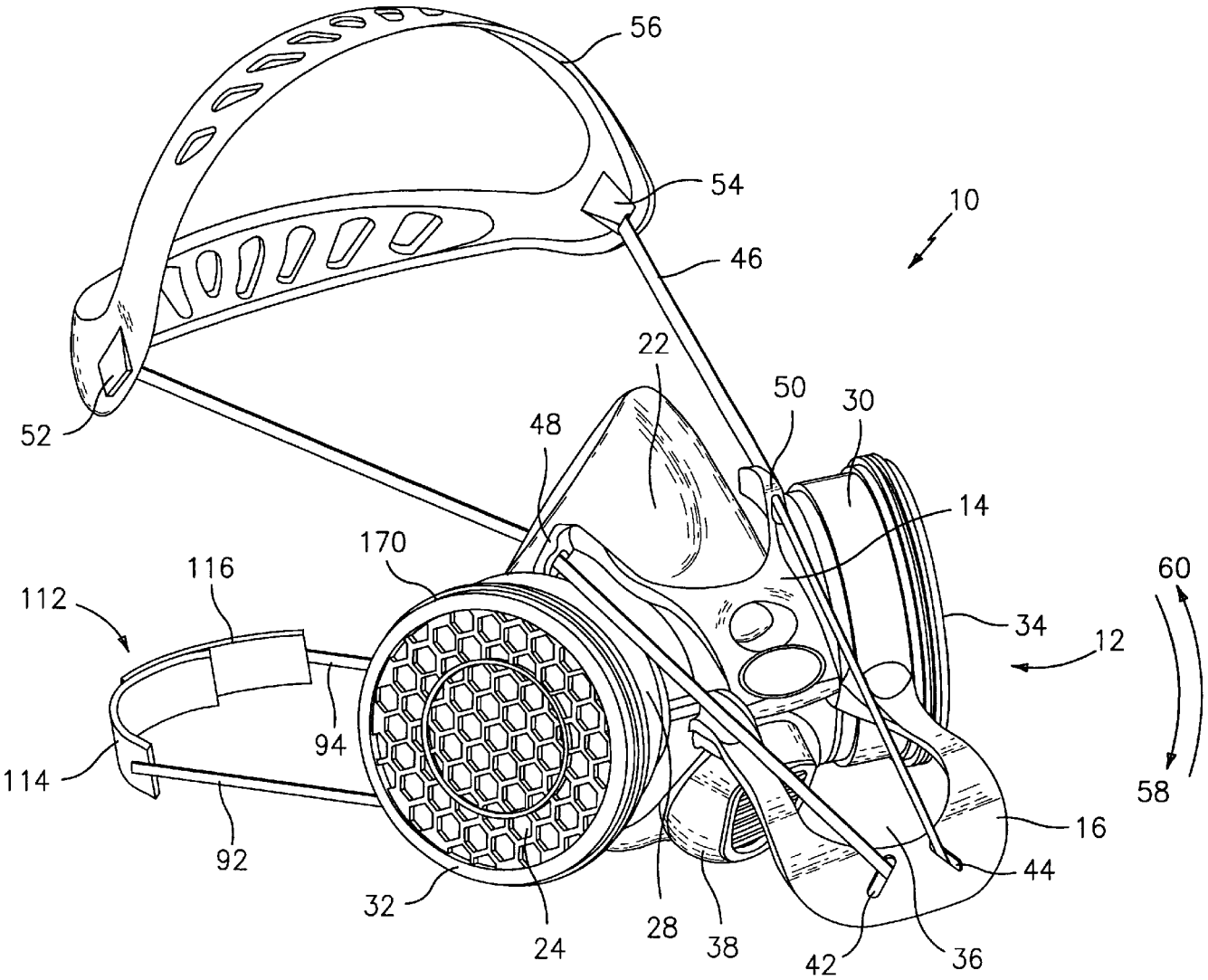
FIG. 1 is a front perspective view of a respirator showing the unlatched position.

Referring to FIG. 1 an exemplary respirator is generally shown at 10. The respirator 10 incorporates a quick release mechanism 12 into a facepiece support system, the quick release mechanism 12 including a yoke 14 and a cam latch 16 pivotally attached to the yoke 14 via hinge pins 18, 20 (shown in FIG. 2). A facepiece 22 is supported by the yoke 14 to fit the facepiece 22 against the face of a wearer. Alternately, the facepiece support system may comprise a facemask/support piece (not shown) such that the facepiece 22 and yoke 14 are integrally molded into a single element by a known process, such as by dual shot molding or over-molding, among others.

Figure 2:
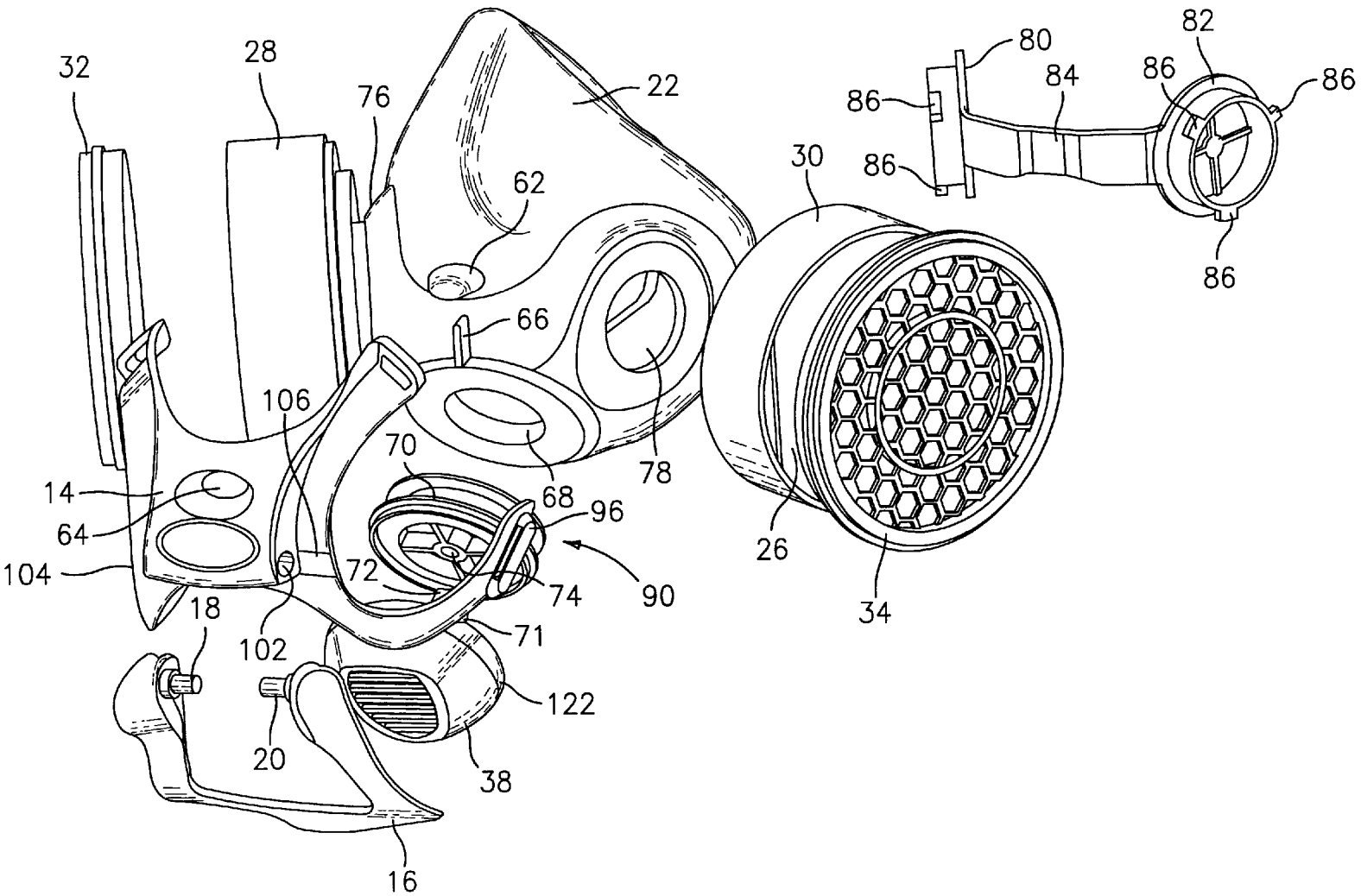
FIG. 2 is an expanded perspective illustration of a respirator facepiece showing the facepiece in an exploded view.

The respirator 10 further may include sorbent material 24, 26 (26 is shown in FIG. 2) positioned on opposite sides of the facepiece 22. The yoke 14 attaches to the facepiece 22 in a removable snap fit fashion against a button type stud (62 in FIG. 2) similar to that of prior art respirators. Sorbent material 24, 26 is disposed within sorbent cartridge shells 28, 30 underneath sorbent cartridge caps 32, 34.

Figure 6:
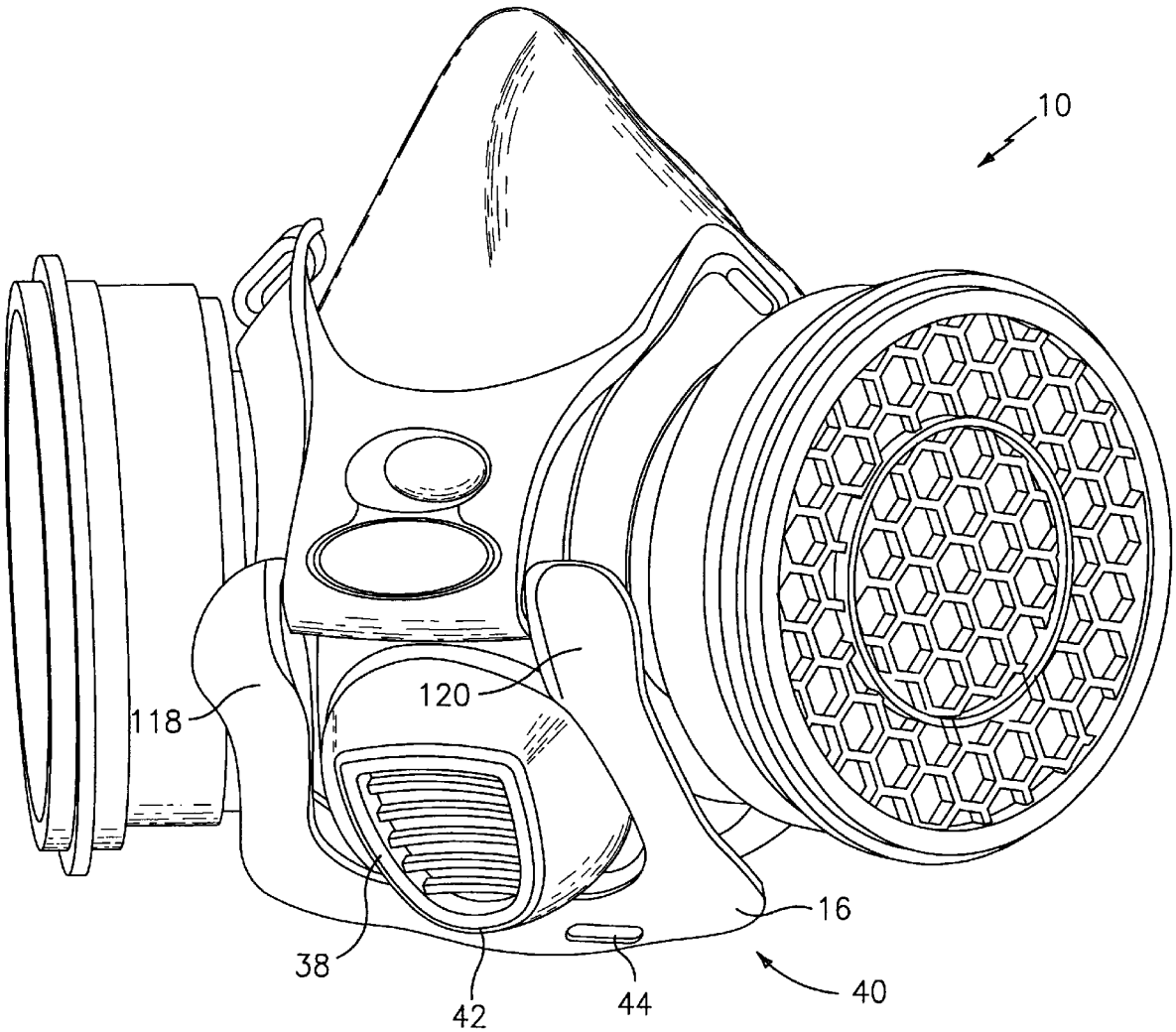
FIG. 6 is a front perspective view of a respirator face showing a latched position.

Referring again to FIG. 1, the exemplary cam latch 16 further includes a relief cut 36 accommodating an exhalation valve housing 38 while the cam latch 16 is in the latched position (shown generally at 40 in FIG. 6). The cam latch 16 further includes first and second relief cuts 42, 44 configured to accept a loop of the upper strap 46. (Alternately, independent straps may be attached at the first and second relief cuts 42, 44) The upper strap 46 extends over a portion of the yoke 14 and through first and second strap guides 48, 50, positioned above the cam latch 16. The upper strap 46 further extends to attach to first and second relief cuts 52, 54 in the headpiece 56. Thus, the cam latch 16 and headpiece 56 are connected, such that downward motion 58 of the cam latch 16 draws the facepiece 22 closer to the headpiece 56, and upward motion 60 of the cam latch 16 relaxes tension in the upper strap 46, allowing the facepiece 22 to fall away from the headpiece 56 into a parked position.

Turning to FIG. 2, an exploded view of exemplary facepiece 22 is shown illustrating a partially pre-assembled state. The facepiece includes a button type stud 62 configured to engage a relief cut 64 on the yoke 14. Similarly, the facepiece 22 includes a button type stud 66 configured to engage a relief cut (not shown) on the yoke 14. The facepiece 22 further includes a centrally located hole 68 configured to accept the exhalation valve seat 70. Exhalation valve housing 38 receives an exhalation valve 71, which further includes a retaining pin 72 sized to engage a retaining hole 74 disposed within the exhalation valve seat 70 (which may snap into the facepiece 22 or be integrally molded into the facepiece 22 by a known process).

Referring again to FIG. 2, an exemplary facepiece 22 may further include first and second side holes 76, 78 configured to accept first and second cartridge/filter retainers 80, 82. The first and second cartridge/filter retainers 80, 82 are shown tethered by a connecting material 84 such that they may be easily installed from the interior of the facepiece 22 and urged outwardly through the first and second side holes 76, 78. Alternately, the cartridge/filter retainers 80, 82 may be integrally molded into the facepiece 22 by any known process.

Referring again to FIG. 2, exemplary first and second cartridge/filter retainers further include a plurality of raised portions 86 configured to engage and retain a portion of the first and second sorbent cartridge shells 28, 30. Sorbent material 26 is shown provided within the sorbent cartridge shell 30 underneath the sorbent cartridge cap 34.

Referring again to FIG. 2, the exemplary yoke 14 may include first and second strap cinchers 88, 90 (88 shown in FIG. 4), positioned below the cam latch 16 and configured to accept the lower neck straps 92, 94 (shown in FIG. 4). As shown, the respirator 10 may incorporate two neck straps 92, 94. However, the present respirator 10 may include a single neck strap (not shown), configured to slip over the head of the wearer or configured to engage the yoke with a mechanical fit, such as a snap-in buckle (not shown).

The exemplary first and second strap cinchers 88, 90 include a post 96 (best shown in FIG. 3) around which a length of strap material is looped and a tooth member 98 (best shown in FIG. 3), which holds the looped strap material in place and retains tension on the strap as it is tightened. Though the yoke 14 are illustrated including the first and second strap cinchers, the lower straps 92, 94 may be attached through the posts 96 by any suitable method such as by being sewn, glued, riveted, or looped through a conventional D-ring (not shown), among others. The yoke 14 also includes first and second hinge pin-retaining holes 100 (not shown), 102 configured to accept the hinge pins 18, 20.

Figure 3:
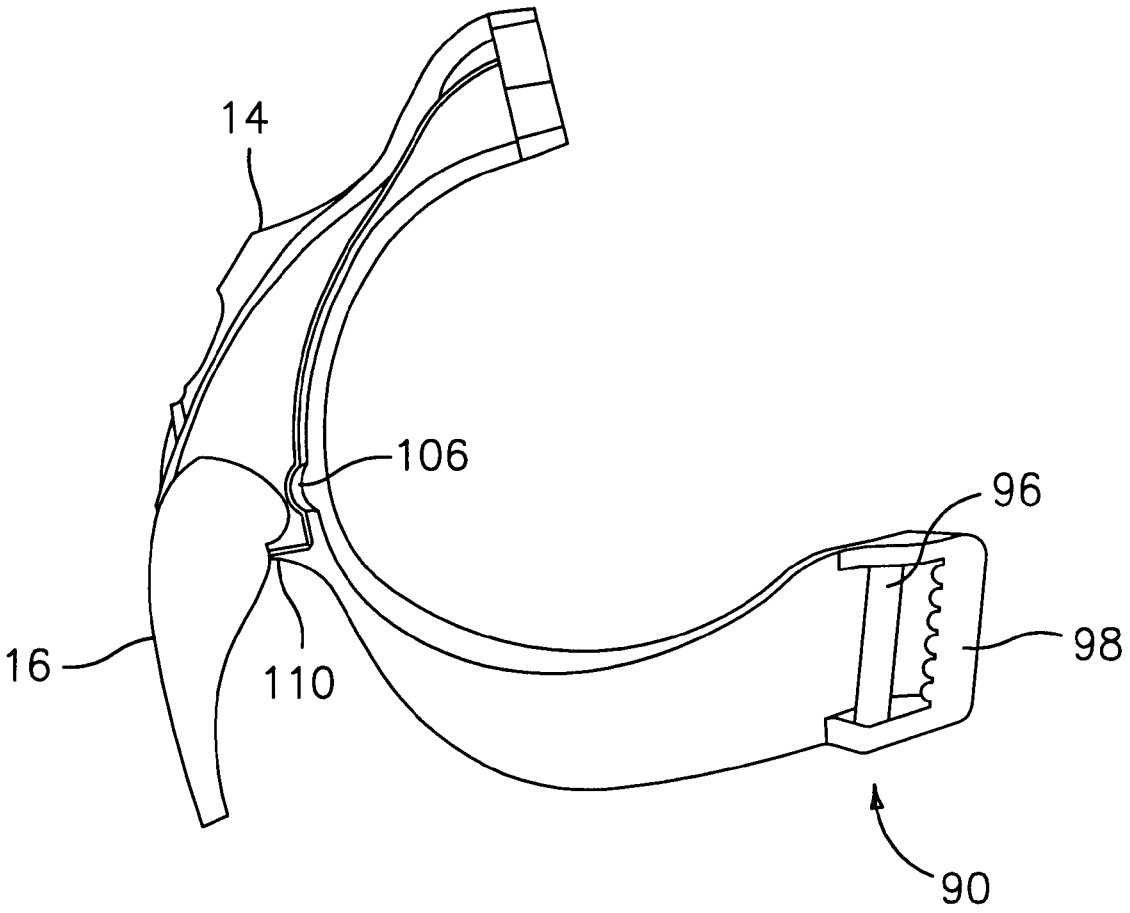
FIG. 3 is a side perspective view illustrating the parts comprising a hinge lock for the latch mechanism.

Referring again to FIG. 2, the exemplary yoke 14 further includes snap locks 104,106 formed or otherwise provided on the outer surface of the yoke 14 proximal to the hinge pins 18, 20. Turning to FIG. 3, the snap locks are sized and configured to receive notched portions 108 (not shown), 110 on the underside of the cam latch 16 proximal to the hinge pins 18, 20. The snap locks 104, 106 and notched portions 108, 110 provide secure engagement of the cam latch 16 in the latched position. Preferably snap locks 104, 106 and notched portions 108, 110 are configured such that an audible snap will occur when the cam latch 16 is engaged.

Figure 4:
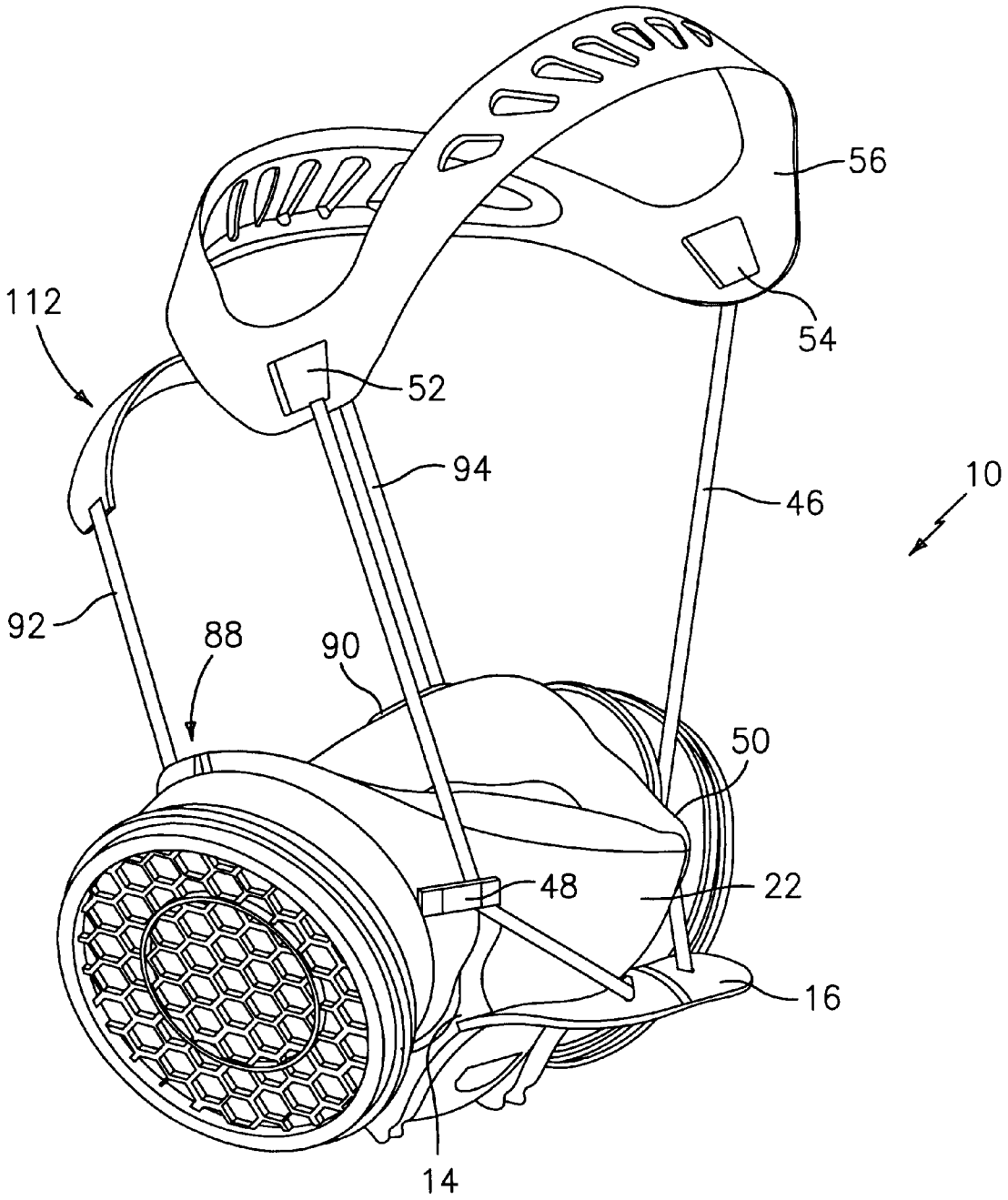
FIG. 4 is a top, left side perspective view of a respirator showing an unlatched position.

Turning now to FIG. 4, an exemplary respirator 10 is shown illustrating an unlatched position. The upper strap 46 extends from the cam latch 16 and through the first and second strap guides 48, 50 to attach to headpiece 56 at relief cuts 52, 54. The lower straps 92, 94 extend from the first and second strap cinchers 88, 90 and attach to the neck catch 112.

In one embodiment, the upper strap 46 comprises a resilient strap material having the flexibility to trace out the path from headpiece 56 through the yoke 14 to the cam latch 16 in both the latched and unlatched positions. Similarly, the lower straps 92, 94 may comprise an elastic material. As used herein, the term strap includes material having any physical cross-section, including rectangular, trapezoidal, circular and elliptical, among others. As best shown in FIG. 1, the upper strap 46 supports and seals the facepiece 22 against the face of the wearer by spreading the tension load in the strap 46 across the cam latch 16, the yoke 14 and the facepiece 22. Spreading the loads as described creates a tight, yet comfortable, fit and seal of facepiece 22 against the face of the wearer.

In one embodiment, the upper strap 46 comprises a material having an elongation sufficiently low such that the strap 46 does not overly stretch when the wearer tightens the strap ends on the headpiece 56, thus allowing for maximum travel of the upper strap 46 through the strap guides 48, 50 when the cam latch 16 is moved to the disengaged, or parked, position. However, some elongation is necessary to allow the strap to flex, for example when the wearer makes facial movements. Accordingly, an exemplary strap elongation is above 0 percent maximum elongation to about 150 percent maximum elongation. In another exemplary embodiment, the maximum strap elongation is between about 10 to about 50 percent. In another exemplary embodiment, the maximum strap elongation is between about 25 to about 35 percent. In another exemplary embodiment, the maximum strap elongation is about 25 percent. The maximum elongation as herein defined allows that a 100 percent maximum elongation corresponds to a strap extension of double its initial length.

Figure 5:
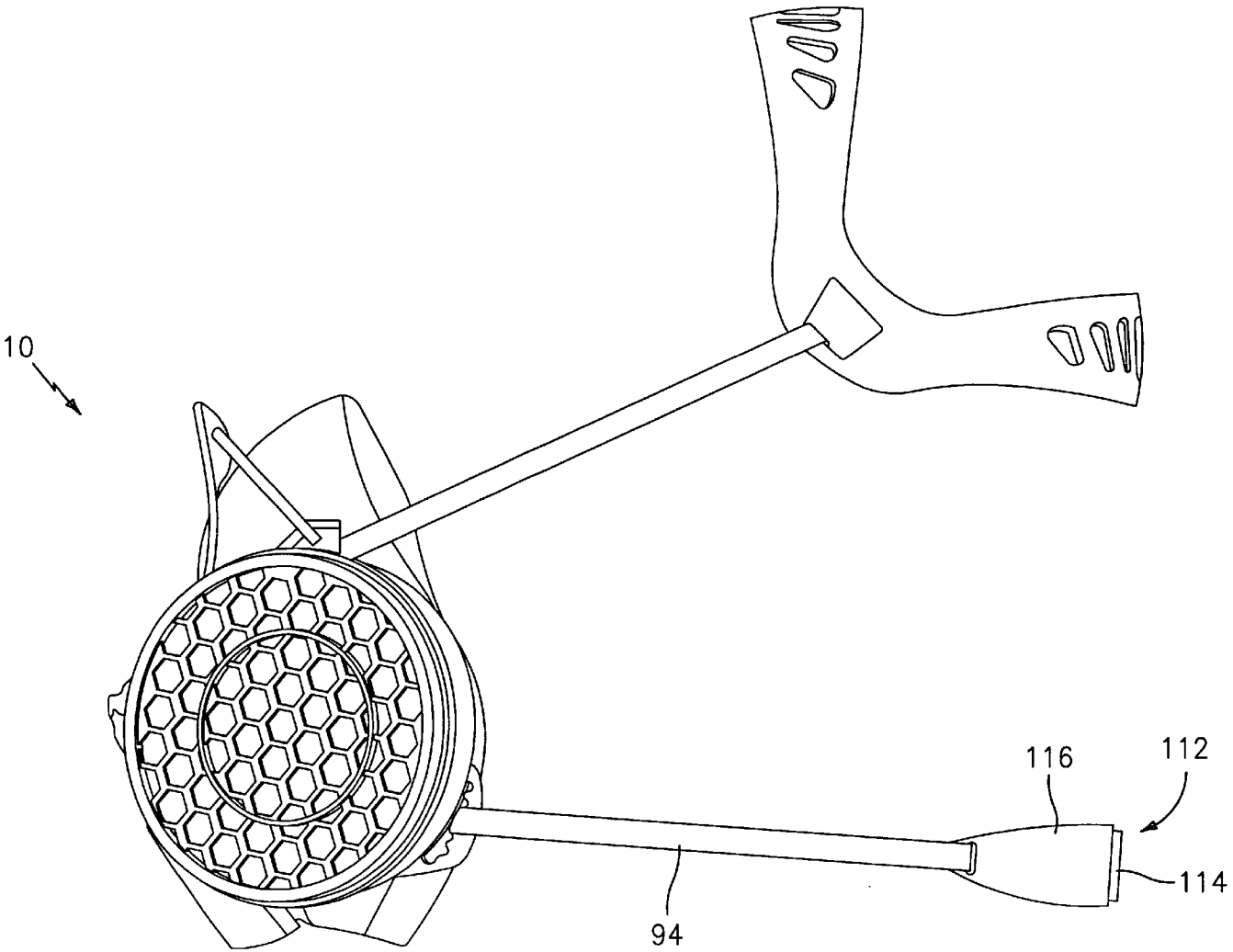
FIG. 5 is a side perspective view of a respirator showing an unlatched position.

Turning now to FIG. 5, a side perspective view of an exemplary respirator 10 is shown illustrating a parked position. A preferred neck catch 112 may comprise a single support piece (not shown), or it may include two engageable/detachable portions 114, 116 (best seen in FIG. 1). The illustrated neck catch 112 advantageously provides a comfortable, rounded fit along the back of the wearer's neck. The engageable/detachable portions 114, 116 may include a mechanical attachment (not shown), such as is known in the art, including Velcro, buckles or hooks and eyes, among others, allowing facile and convenient donning and doffing of the neck catch 112. Alternately, the lower straps 92, 94 may attach to a side buckle (not shown) positioned alongside the neck of the wearer.

Turning now to FIG. 6, a front perspective view of an exemplary respirator 10 illustrates a latched position 40. The cam latch 16 includes a first and second concave regions 118, 120 configured to retain the upper strap 46 when the cam latch 16 is in a latched position. Thus, the upper strap 46 (not shown), which is angled from the first and second strap guides 48, 50 across the concave regions 118, 120, around the exhalation valve housing 38 and through the first and second relief cuts 42 (not shown), 44 effectively holds the cam latch 16 in position by pressure of the upper strap 46 against the first and second concave regions 118, 120. When the latch 16 is in the latched position under the chin of the wearer, the upper strap 46 further supports the facepiece 22 and biases it towards the face of the wearer.

The illustrated exhalation valve housing 38 further includes a ridge of material 122 (best seen in FIG. 2) disposed just interior to the relief cut 36 along a portion of the cam latch 16. The ridge of material 122 is configured to engage the cam latch 16 in the latched position to further ensure that the cam latch 16 is secure. In one exemplary embodiment, the configurational fit between the ridge of material 122 and the cam latch 16 is such that latching of the cam latch 16 creates an audible click or snap. This farther ensures that the wearer is certain that the cam latch 16 is secure.

Figure 7:
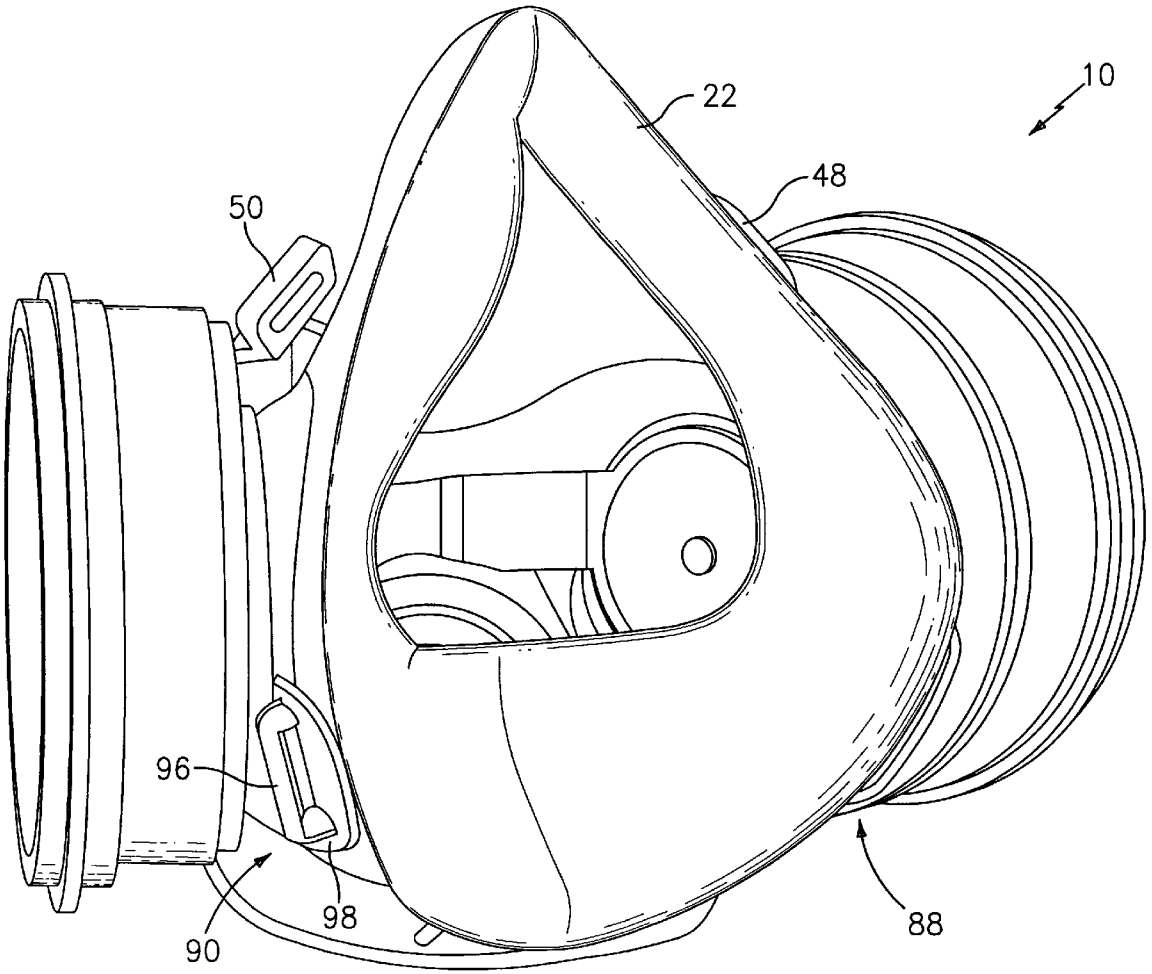
FIG. 7 is a rear perspective view of a respirator showing a rear aspect of a facepiece and showing strap points of engagement with the yoke.

Turning now to FIG. 7, a rear perspective view of an exemplary respirator 10 illustrates the rear aspect of the facepiece 22, the first and second strap guides 48, 50, and the first and second strap cinchers 88, 90. The rear aspect of the facepiece 22 includes readily deformable material around all points of contact with the face of the user to provide a comfortable and secure fit regardless of facial contouring. Accordingly, it is preferable that facepiece 22 comprise a resilient material, such as liquid silicone, rubber, or a thermoplastic elastomer, among others. The post 96, around which a length of lower strap material is looped, and the tooth member 98 of the second strap cincher 90 are particularly evident in this aspect.

Figure 8:
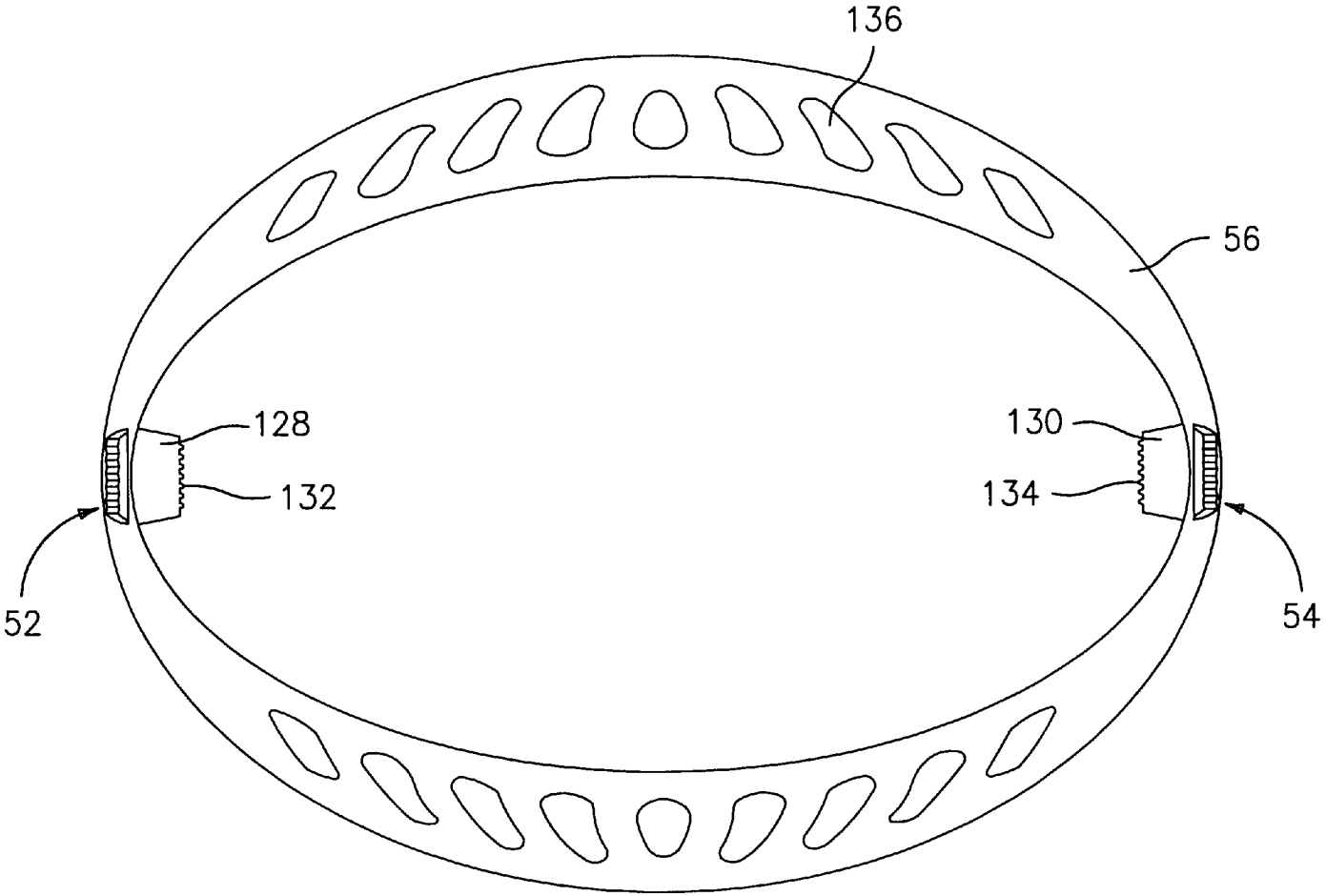
FIG. 8 is a perspective view of the inside surface of a headpiece.
Figure 9:
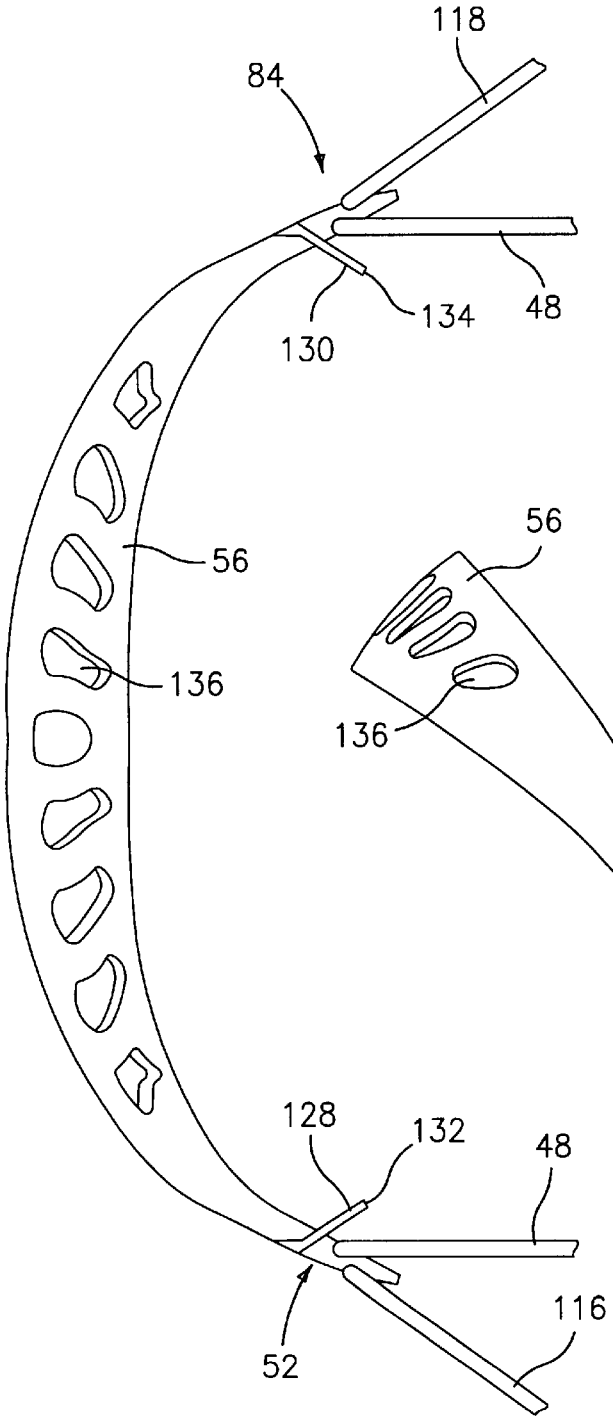
FIG. 9 is a front cross sectional view of the headpiece of FIG. 8 along lines 2—2.
Figure 10:
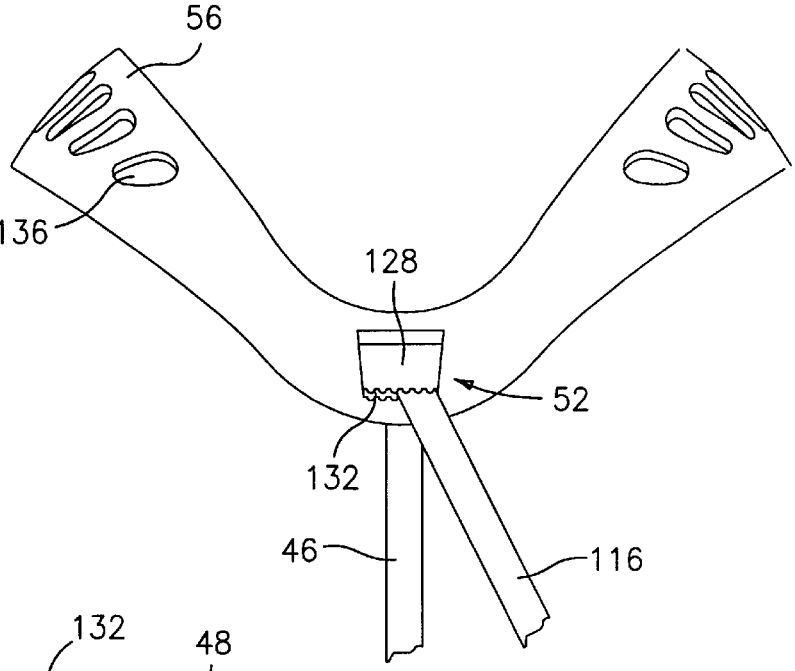
FIG. 10 is a side cross sectional view of the headpiece of FIG. 8 along lines 4—4.

Turning now to FIG. 8, an exemplary headpiece 56, including cinching relief cuts 52, 54, is illustrated. The attachment of the upper strap 46 to the headpiece 56 may be accomplished in a variety of ways, including use of plastic rivets (not shown) swaged over by a known process, such as ultrasonic welding. However, the illustrated headpiece 56 includes first and second relief cuts 52, 54 comprising toothed, or uneven, incisions through the material of the headpiece 56 through which the upper strap 46 is passed. Thus, the user may tighten the upper strap 46 by simply pulling on ends 116, 118 (shown in FIGS. 9 and 10) of the strap 46. Incising of headpiece material provides flaps 128, 130, the toothed, or uneven, regions 132, 134 of which will hold the strap ends 116, 118 in place and maintain tension in the upper strap 46.

Referring again to FIGS. 8, 9 and 10 the exemplary headpiece 56 shown includes cutouts 136, which provide ventilation and flexibility to the headpiece 56.

Figure 11:
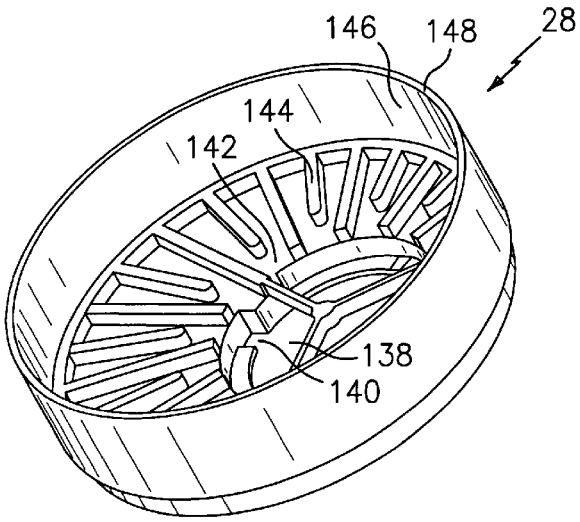
FIG. 11 is a top perspective view of a sorbent cartridge shell component.

Turning now to FIG. 11, an exemplary sorbent cartridge shell 28 is shown. The sorbent cartridge shell 28 includes the preferable off-center opening 138 (the off-center aspect of which shifts the sorbent cartridge out of the wearer's view), including recessed portions 140 configured and arranged to receive the raised portions 86 of the first and second cartridge/filter retainers 80, 82, a base portion 142, including ridges 144, and a sidewall portion 146, including an upper edge 148. The configuration of recessed portions 140 on the sorbent cartridge shell 28 and raised portions 86 on the first and second cartridge/filter retainers allows quick and facile installation or removal of the sorbent cartridge shell 28 via a simple twisting motion. The ridges 144 on the base portion 142 set the sorbent material (not shown) away from the base portion 142, allowing an optimal amount of filter material surface area to be exposed. This reduces pressure loads and allows for easier breathing and more efficient filtering. Preferable material for this sorbent cartridge shell 28 includes carbon and absorbent filter materials.

Figure 12:
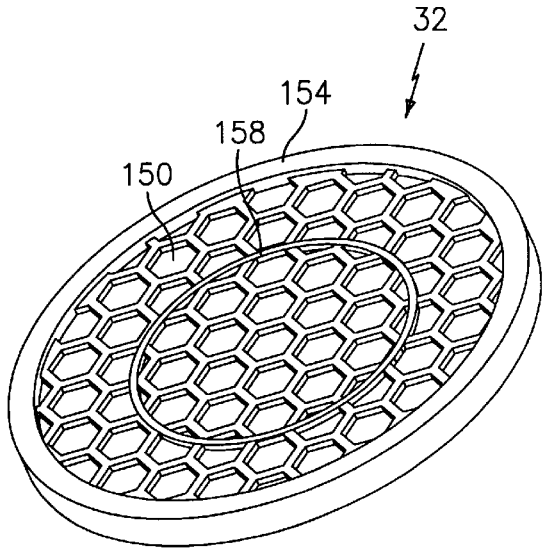
FIG. 12 is a top perspective view of a sorbent cartridge cap component.
Figure 13:
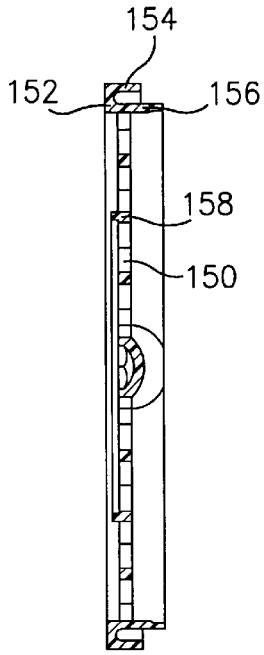
FIG. 13 is a side perspective view of the sorbent cartridge cap of FIG. 12.

Turning now to FIGS. 12 and 13, an exemplary sorbent cartridge cap 32 is illustrated. The sorbent cartridge cap 32 includes a plurality of openings 150, an upper circumferential edge 152, an outer rim 154 and an inner rim 156. As preferred, the plurality of openings 150 are arranged as hexagonal openings defined by the material of the sorbent cartridge cap 32 to maximize the exposed surface area of the underlying filter material (not shown). An inner ring 158 of cap material may be provided, as illustrated, to decrease flex in the cap 32, re-enforce the structure and set the filter disc (not shown) away from the cap material to increase the effective exposed filter disc surface area. The outer and inner rims 154, 156 of the sorbent cartridge cap 32 are sized and configured to guide the upper edge 148 of the sorbent cartridge shell 28 into place during sorbent cartridge assembly. In one exemplary embodiment, the outer and inner rims 146, 148 of the sorbent cartridge cap 32 are sized and configured to securely engage the upper edge of the sorbent cartridge shell 28. The sorbent cartridge cap 32 may be connected to the sorbent cartridge shell 28 as is known in the art. In one exemplary embodiment, the filter cartridge cap is snapped or welded to the sorbent cartridge shell 28.

Figure 14:
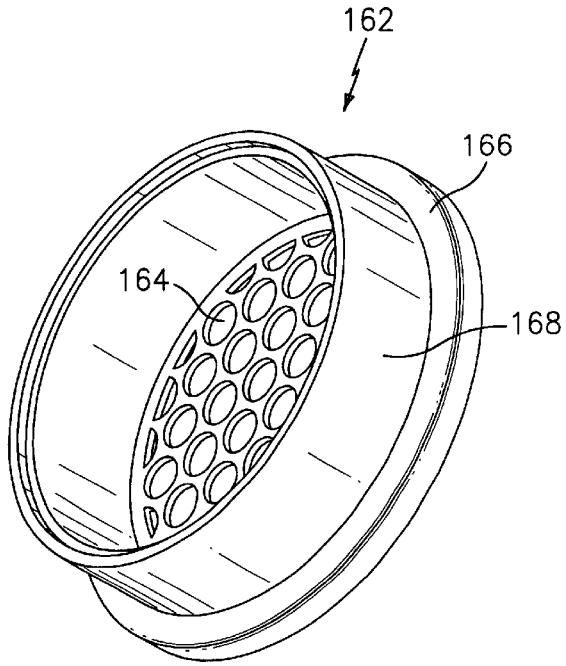
FIG. 14 is a rear perspective view of a second cartridge shell component.

Referring now to FIG. 14, an exemplary second cartridge shell 162 is illustrated. The second cartridge shell 162 may be sized and configured to receive a pleated, particulate filter (not shown). The second cartridge shell 162 includes a plurality of openings 164, lower circumferential edge 166 and an extended rim 168. In this embodiment, the plurality of openings 164 are arranged as circular openings defined by the material of the sorbent cartridge 162, less preferred than hexagonal openings, but still providing a good amount of exposed surface area of the contained sorbent material (not shown). One advantageous embodiment provides that the extended rim 168 of the second cartridge shell 162 be sized and configured to receive a pleated filter (not shown), which filters particulate materials. The second cartridge shell 162 preferably is permanently attached, by welding, snapping or other known methods, to the top of the sorbent cartridge shell 30. Alternately, the second cartridge shell 162 may be configured to engage threading 170 (shown in FIG. 1) (preferred where the second cartridge shell 162 is used) disposed on the sorbent cartridge cap 32.

Figure 15:
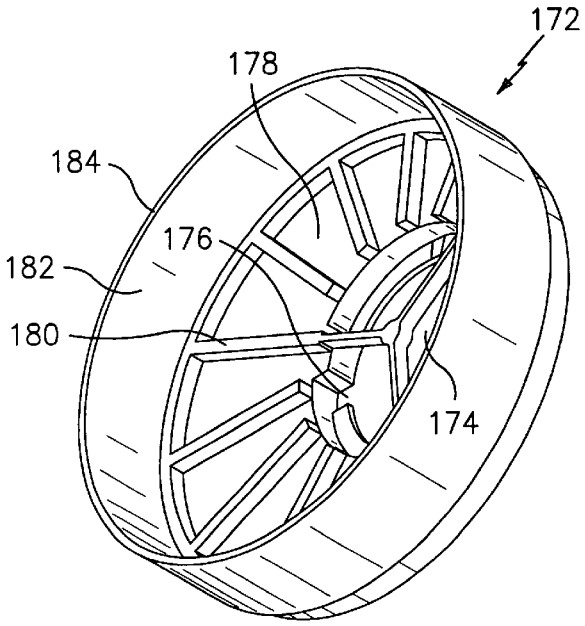
FIG. 15 is a top perspective view of a standalone filter cartridge shell component.

Turning now to FIG. 15, an exemplary standalone filter cartridge shell 172 component is illustrated. The standalone filter cartridge shell 172 is illustrated including an off-center opening 174 (the off-center aspect of which shifts the standalone filter out of the wearer's view), including recessed portions 176 configured and arranged to receive the raised portions 86 of the first and second cartridge/filter retainers 80, 82, a base portion 178, including ridges 180, and a sidewall portion 182, including an upper edge 184. The configuration of recessed portions 176 on the standalone filter cartridge shell 172 and raised portions 86 on the first and second cartridge/filter retainers 80, 82 allows quick and facile installation or removal of the standalone filter cartridge shell 172 via a simple twisting motion. The ridges 180 on the base portion 178 set the filter material (not shown) away from the base portion 178, allowing an optimal amount of filter material surface area to be exposed. This reduces pressure loads and allows for easier breathing and more efficient filtering. Suitable material for the standalone filter cartridge shell 172 includes, among others, filter materials capable of filtering particulates, and in particular, pleated particulate filters.

Figure 16:
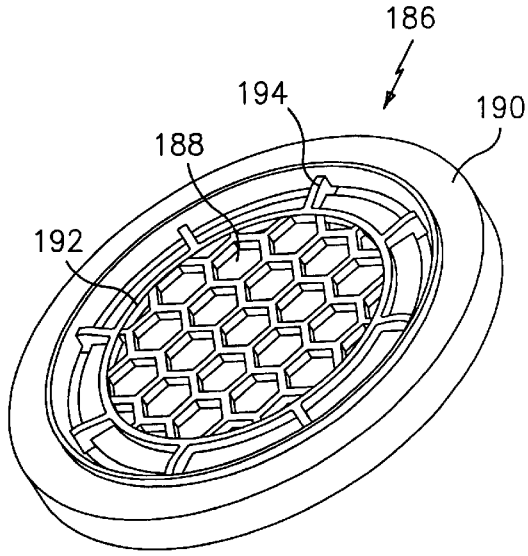
FIG. 16 is a rear perspective view of a filter cartridge cap component.

Turning now to FIG. 16, an exemplary filter cartridge cap 186 is illustrated. The filter cartridge cap 186 includes a plurality of openings 188 (as shown, hexagonal openings are preferred), an upper circumferential edge 190 and an inner ring 192, connected to the upper circumferential edge 190 by spokes 194. The upper circumferential edge 190 is sized and configured to securely engage the extended rim of either the second cartridge shell 162 or the standalone filter cartridge shell 172. As shown, it is preferred that the inner ring 192 extend downward relative to the upper circumferential edge 190 to expose a maximal surface area of the second filter material (not shown). While the snap fit is illustrated, the second filter cartridge cap 172 may engage the second cartridge shell 162 or the standalone filter cartridge shell 172 by any known method, including gluing, threading, snap fits and welding, among others.

Figure 17:
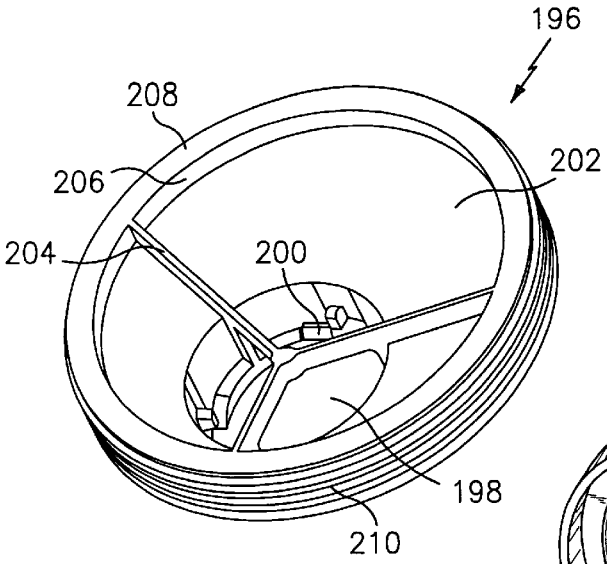
FIG. 17 is a top perspective view of a disc filter base component.

Referring now to FIG. 17, an exemplary disc filter base 196 component is illustrated. The disc filter base 196 includes the preferable off-center opening 198 (the off-center aspect of which shifts the disc filter out of the wearer's view), including recessed portions 200, configured and arranged to receive the raised portions 86 of the first and second cartridge/filter retainers 80, 82, a base portion 202, including ridges 204, and a sidewall portion 206, including an upper edge 208. The configuration of recessed portions 200 on the disc filter base 196 and raised portions 86 on the first and second cartridge/filter retainers 80, 82 allows quick and facile installation or removal of the disc filter base 196 via a simple twisting motion. The ridges 204 on the base portion 202 set the filter material (not shown) away from the base portion 202, allowing an optimal amount of filter material surface area to be exposed. This reduces pressure loads and allows for easier breathing and more efficient filtering. As shown, the disc filter base 196 may also include external threads 210 to accommodate a threaded cover and an exemplary cover of which is described below.

Figure 18:
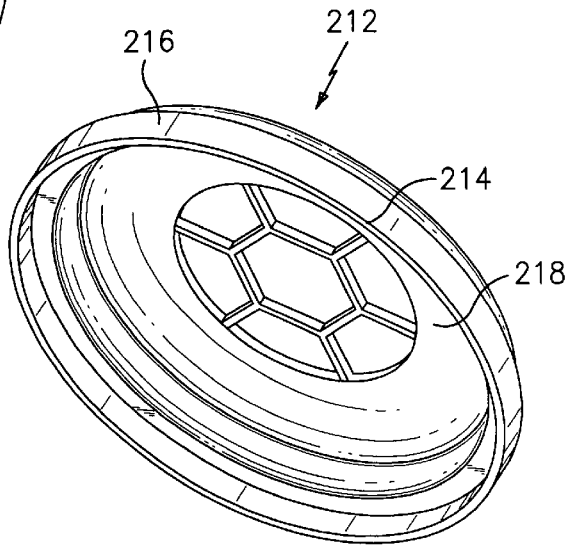
FIG. 18 is a rear perspective view of a disc filter cover component.

Referring now to FIG. 18, an exemplary disc filter cover 212 is illustrated. The disc filter cover 212 includes a lower circumferential rim 214, a sidewall portion 216, a ceiling portion 218 and a plurality of openings 220 disposed through the ceiling portion 218. The lower circumferential rim 214 and sidewall portions 216 are configured engage the upper circumferential edge 152 of the sorbent cartridge cap 32 or the upper edge 208 of the disc filter base 196 and receive a disc filter material (not shown). While the snap fit embodiment is illustrated, the disc filter cover 212 may engage the first sorbent cartridge cap 32 or the disc filter base 196 by any known method, including threading, snap fits and welding, among others.

The present respirator 10 is donned via manipulation of the cam latch 16 of quick release mechanism 12. Donning is begun with the cam latch 16 in the up and unlatched position. A wearer grasps the headpiece 56 with one hand and the yoke 14 or exhalation valve housing 38 with the other hand. The two detachable portions 114, 116 of the neck catch 112 are positioned around the neck of the user and secured along with lower straps 92, 94. The headpiece 56 is guided over the top of the head and the facepiece 22 is placed proximal to the face. The cam latch 16 is then lowered in the direction of the arrow 58 (in FIG. 1) into the latched position.

The respirator 10 is doffed by reverse (upward) motion of the cam latch 16. The cam latch 16 rotates in the direction of the arrow 60 (in FIG. 1) about the pivot pins 18, 20 to the unlatched position. The quick release mechanism 12 is actuated in this fashion partially by manipulative force of the user, partially by the tension stored in the upper strap 46 and partially by the weight of the lower portion of the respirator 10. Thus, the quick release mechanism 12 is actuated and the respirator parked simply by applying thumb pressure against cam latch 16. In addition, respirator 10 in accordance with the present invention can be doffed without the removal of other safety headgear such as, for example, safety glasses (not shown).

Figure 19:
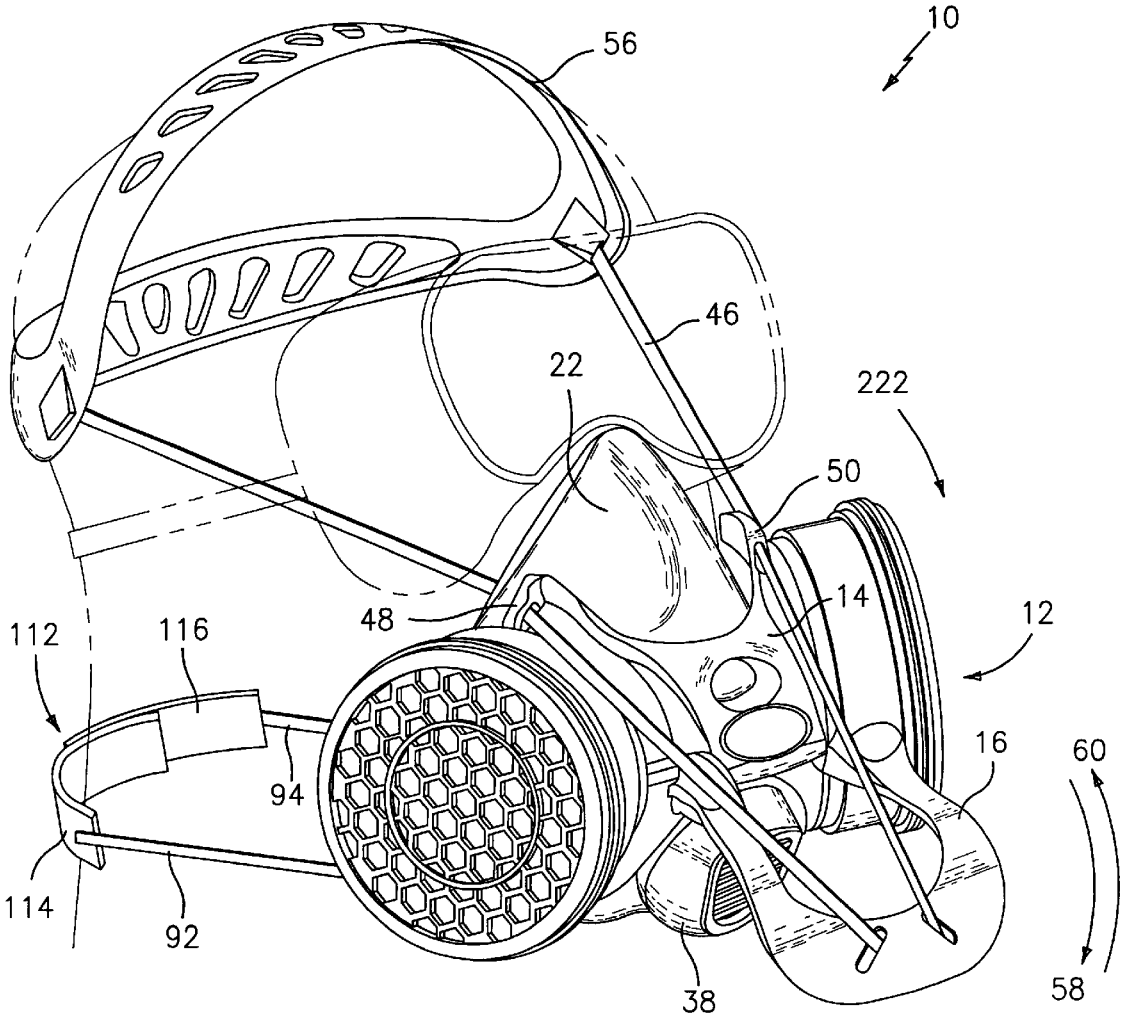
FIG. 19 is a front perspective of a respirator in a parked position.

Turning to FIG. 19, further illustration of exemplary respirator 10 parking is shown. As can be seen, the present respirator 10 provides for a convenient and comfortable parked position. Once the respirator 10 is doffed as described above, the yoke 16 rotates upwards, relative to the wearer's face, and the effective length of the upper strap 46 between the headpiece 56 and the facepiece 22 is increased. The facepiece 22 drops away from the face of the wearer in the direction indicated by arrow 222. In one embodiment, the upper strap 46 slides as much as four inches through the guide holes 48, 50 as the yoke 16 is moved from the latched position to the unlatched position. Thus, the respirator 10 is effectively parked without removal of neck catch 112 from the neck or removal of the headpiece 56 from the top of the head. Donning the respirator 10 from the parked position simply requires that the facepiece 22 be lifted into position on the face while the cam latch 16 is flipped downward in direction of the arrow 58, preferably with the use of just one hand.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A quick release respirator mechanism comprising:

a yoke attached to a respirator face mask;

a latch attached to the yoke;

at least one guide associated with the yoke;

at least one strap attached to the latch, the at least one strap disposed within the at least one guide.

2. A mechanism as set forth in claim 1 wherein the latch is pivotally attached to the yoke at a first end of the latch.

3. A mechanism as set forth in claim 1, further including at least one opening in the face mask, and wherein the at least one opening includes at least one filter disposed within the opening.

4. A mechanism as set forth in claim 1, wherein the respirator mechanism further includes a headpiece, wherein the yoke includes a pair of guide holes, a pair of straps are attached to the latch at a pair of lock holes positioned in the latch at a second end thereof, and wherein the pair of straps are disposed within the pair of guide holes and are attached to the headpiece.

5. A mechanism as set forth in claim 4 wherein the straps are comprised of a resilient material having a substantially round cross section.

6. A mechanism as set forth in claim 4 wherein the latch is pivoted from an unlatched position to a latched position, and wherein a tension force is produced in the straps in the latched position biasing the mask against a face of a wearer.

7. A mechanism as set forth in claim 4, further comprising:

a pair of attachment points positioned in the yoke; and a pair of straps attached to the headpiece, the straps disposed at the attachment points.

8. A mechanism as set forth in claim 7 wherein the attachment points each comprise a cinching mechanism comprising a pair of slots.

9. A mechanism as set forth in claim 8 wherein the cinching mechanisms comprise a D-ring attached to the yoke.

10. A mechanism as set forth in claim 1 wherein the yoke is comprised of a rigid plastic material.

11. A mechanism as set forth in claim 1 wherein the latch is comprised of a rigid plastic material.

12. A quick release respirator mechanism comprising:

a yoke attached to a respirator face mask;

a latch attached to the yoke;

at least one guide associated with the yoke;

at least one strap attached to the latch;

at least one opening disposed in the face mask;

at least one filter disposed within the opening.

13. A mechanism as set forth in claim 12 wherein the latch is pivotally attached to the yoke at a first end of the latch.

14. A mechanism as set forth in claim 12, wherein the respirator mechanism further includes a headpiece, wherein the yoke includes a pair of guide holes, a pair of straps is attached to the latch at a pair of lock holes positioned in the latch at a second end thereof, and wherein the pair of straps are disposed within the pair of guide holes and are attached to the headpiece.

15. A mechanism as set forth in claim 14 wherein the straps are comprised of a resilient material having a substantially round cross section.

16. A mechanism as set forth in claim 14 wherein the latch is pivoted from an unlatched position to a latched position, and wherein a tension force is produced in the straps in the latched position biasing the mask against a face of a wearer.

17. A mechanism as set forth in claim 14, further comprising:

a pair of attachment points positioned in the yoke; and a pair of straps attached to the headpiece, the straps disposed at the attachment points.

18. A mechanism as set forth in claim 17 wherein the attachment points each comprise a cinching mechanism comprising a pair of slots.

19. A mechanism as set forth in claim 18 wherein the cinching mechanisms comprise a D-ring attached to the yoke.

20. A mechanism as set forth in claim 12 wherein the yoke is comprised of a rigid plastic material.

21. A mechanism as set forth in claim 12 wherein the latch is comprised of a rigid plastic material.

* * * * *